United States Patent [19]

Yagher, Jr.

[11] 4,085,397

[45] Apr. 18, 1978

[54] ELECTRICAL SWITCHING DEVICE FOR THERMAL AND OVERVOLTAGE PROTECTION

[75] Inventor: Charles Yagher, Jr., Centerville, Ohio

[73] Assignee: Emerson Electric Co., St. Louis, Mo.

[21] Appl. No.: 801,747

[22] Filed: May 31, 1977

[51] Int. Cl.[2] ..... H01H 37/76

[52] U.S. Cl. ..... 337/407; 337/409

[58] Field of Search ..... 337/407, 408, 409

[56] References Cited

U.S. PATENT DOCUMENTS

| | | | |
|---|---|---|---|
| 2,934,628 | 4/1960 | Massar et al. | 337/409 |
| 3,180,958 | 4/1965 | Merrill | 337/409 |

*Primary Examiner*—George Harris

*Attorney, Agent, or Firm*—Biebel, French & Nauman

[57] ABSTRACT

A normally open temperature sensitive electrical switching device includes a heat fusible electrically conductive pellet which melts and provides an electrically conductive path through the switching device at a predetermined temperature level and, further, includes arc contacts defining an air gap across which arcing will occur when a sufficient potential is supplied to the switching device. A first electrically conductive electrode and second electrically conductive electrode are electrically connected to first and second electrical leads provided for an electrical connection to the device. A nonconductive mounting arrangement holds the first and second electrodes in spaced relation. The heat fusible conductive pellet is positioned in contact with the second electrode and defines the air gap of predetermined dimension with the first electrode. Current will therefore flow between the first and second electrical leads when the voltage across the air gap is sufficient to cause arcing or when the fusible pellet is heated to its predetermined fusion temperature.

8 Claims, 4 Drawing Figures

PRIOR ART

PRIOR ART

ELECTRICAL SWITCHING DEVICE FOR THERMAL AND OVERVOLTAGE PROTECTION

BACKGROUND OF THE INVENTION

The present invention relates to temperature sensitive electrical switching devices and, more particularly, to a temperature sensitive device which is normally open but which closes an electrical circuit when the temperature of the device is raised to a predetermined temperature level and which device provides an air gap path through the device to permit arcing across the gap when a voltage of sufficient magnitude is applied to the device.

Thermally actuatable switch constructions are presently known in which an electric circuit is opened or closed in response to the switch being heated to a predetermined temperature level. In U.S. Pat. No. 3,875,546, issued Apr. 1, 1975, to Merrill, and U.S. Pat. No. 3,519,972, issued July 7, 1970, to Merrill, both assigned to the assignee of the present invention, temperature responsive electrical switches are disclosed in which a sliding electrical contact is held against a second electrical contact by a relatively stiff spring, which spring bears upon a normally solid, heat fusible, nonconductive pellet. When the pellet fusion temperature is reached, the pellet will melt and the stiff spring will no longer oppose the force of a somewhat weaker spring which then moves the sliding contact away from the second contact.

A normally open electrical switching device is disclosed in U.S. Pat. No. 3,189,508, issued Apr. 27, 1965, to Merrill and assigned to the assignee of the present invention. In the device disclosed therein, a sliding contact is moved into electrical contact with a stationary contact after fusion of a nonconductive heat fusible material.

It is also known to provide momentary overvoltage protection for various types of electrical machines by placing arc contacts in parallel electrically with the power terminals of the machine to be protected. When there is a momentary surge of line voltage, the excessive potential across the contacts will result in arcing and the machinery will therefore be protected. If the overvoltage condition should exist for a substantial period of time, the high current will blow the line fuses in the power supply line, permanently disconnecting the protected machine from the source of line power. If, on the other hand, the overvoltage condition exists only for a relatively short period of time, the arcing across the protective arc gap contacts may cease before sufficient current has passed through the line fuse to cause the fuse to blow. The protected machine will, therefore, resume its normal operations.

Heat sensitive, normally open electrical switches have in the past been placed in physical proximity to a protected electrical machine and connected electrically in parallel with the machine. If the machine should overheat during operation, the switch will close, thus causing a large current to flow through the power lines and resulting in the line fuse being blown. Previously, such thermal protectors have been separate from overvoltage protection devices, and added labor required for their connection into the circuits. Additionally the use of two discrete devices has increased the cost of the protection circuitry.

Thus, it is seen that there is a need for a combined normally open heat sensitive switching device and an overvoltage arc protector in which the air gap is accurately controlled and in which the construction of the device is simple and its operation extremely reliable.

SUMMARY OF THE INVENTION

A normally open, temperature sensitive electrical switching device having first and second electrical leads comprises a first electrically conductive electrode means which is electrically connected to the first electrical lead and a second electrically conductive electrode means which is electrically connected to the second electrical lead. A non-conductive means for mounting the first and second electrode means in spaced relation is provided. A heat fusible pellet means is positioned in contact with the second electrode means and defines an air gap of predetermined dimension with the first electrode means. The pellet means is made of a material which will melt at a predetermined temperature and form an electrically conductive path between the first and second electrode means. The air gap is sufficient to permit arcing thereacross when an excessive voltage is applied to the first and second electrical leads.

An insulator means may be positioned between the conductive pellet and the first electrode means such that the predetermined dimension of the air gap therebetween is maintained. The first electrically conductive electrode means may include an electrically conductive case which is connected to the first lead, with the case having a first end defining an opening into a central cavity and a second end which is closed. The nonconductive means for mounting the first and second electrode means in such an arrangement may include a means for positioning the second electrode in the central cavity defined by the case. An electrically conductive spacer means in the cavity and a spring means may be provided for urging the spacer means into direct abutting contact with the insulator means. The insulator means may be an annular piece of mica such that the air gap is defined through the center opening in the insulator means between the pellet means and the electrically conductive spacer means.

Accordingly, it is an object of the present invention to provide a heat sensitive electrical switching device which also includes an overvoltage protective air gap; to provide such a device in which an electrically conductive path will be provided between the power leads when the device is heated to a predetermined temperature level; to provide such a device in which the device operation is extremely reliable and in which the device assembly is simple; to provide such a device in which the overvoltage air gap is dimensioned precisely; and, to provide such a device in which the device actuates at substantially the desired predetermined temperature level.

Other objects and advantages of the present invention will be apparent from the following description, the accompanying drawings and the appended claims.

DETAILED DESCRIPTION OF THE INVENTION

The present invention relates to a unique electrical switching device which provides overvoltage protection and thermal protection for electric apparatus.

Figure 1:
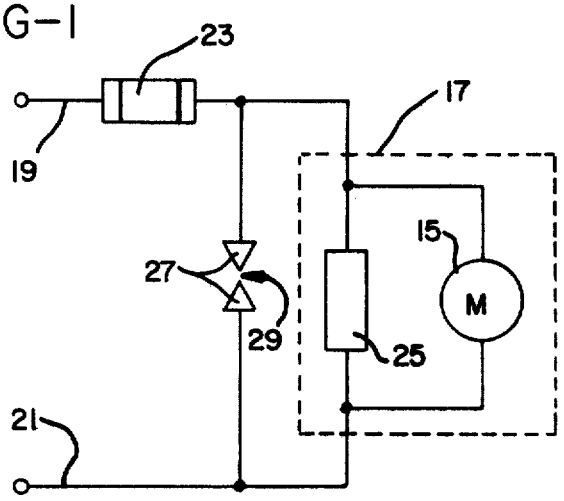
FIG. 1 is a circuit schematic of a prior art protective arrangement for an electrical device.

Reference is made to FIG. 1 in which a prior art protective arrangement is illustrated schematically. An electrical device to be protected, such as motor 15, is positioned in a cabinet 17 and connected electrically to power lines 19 and 21. Fuse 23 is provided in series with the motor 15 in order to provide protection for excessive current conditions. A normally open thermally actuatable switching device 25 is positioned adjacent the motor 15 in cabinet or housing 17 and is connected electrically in parallel with the motor 15. Should motor 15 overheat for any reason such that the predetermined temperature level for actuation of the device 25 is exceeded, device 25 will become conductive and motor 15 will be shunted. Since a current path will be provided across lines 19 and 21, a large current will be drawn and fuse 23 will be blown quickly. Switching device 25 has generally been of the type which becomes permanently conductive when the predetermined temperature level is exceeded.

In a somewhat similar manner, arc contacts 27 define an arc gap 29 which provides protection for motor 15 against voltage surges on the power lines 19 and 21. The spacing of the arc gap will be set such that arcing will begin when a predetermined voltage level is exceeded. When this level is exceeded, the arcing across gap 29 will effectively shunt motor 15 and provide protection against damage from overvoltage transients. Should the overvoltage condition exist for a substantial period of time, fuse 23 will be blown.

Figure 2:
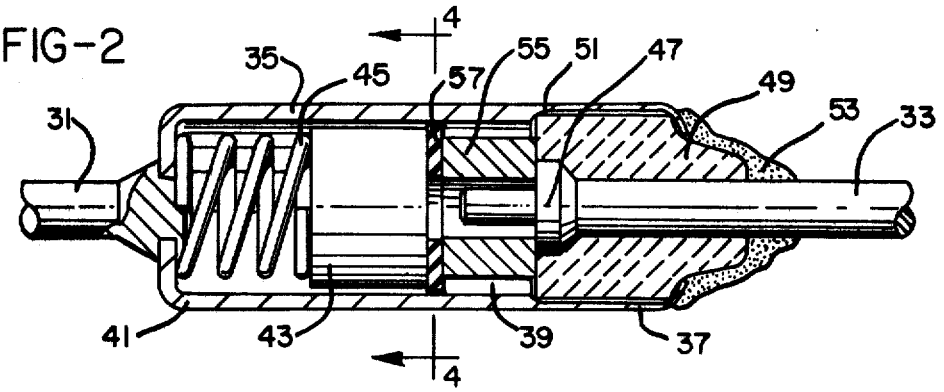
FIG. 2 is a partial sectional view taken generally axially with respect to the device of the present invention, prior to thermal actuation.
Figure 3:
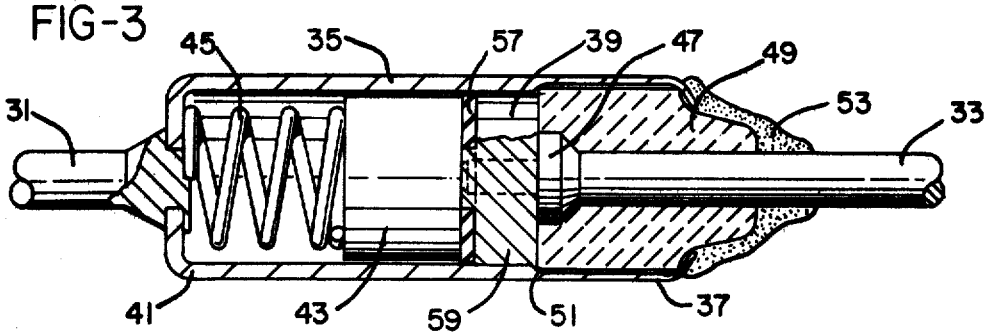
FIG. 3 is a view similar to FIG. 1 showing the switch condition after the switch is heated to a predetermined temperature level and thermal actuation occurs.
Figure 4:
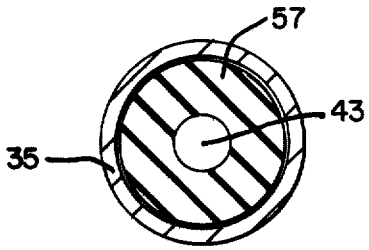
FIG. 4 is a view taken generally along line 4—4 in FIG. 2.

Reference is now made to FIGS. 2, 3 and 4 in which is shown a temperature sensitive electrical switching device having provision for overvoltage protection, which device embodies the present invention. The switching device has first and second current carrying electrical leads 31 and 33, respectively, and provides a completed electrical circuit between these leads when the temperature of the device exceeds a predetermined temperature level. Additionally, an overvoltage arc gap is provided such that current will flow between leads 31 and 33 when the voltage across the device exceeds a set potential level. A first electrically conductive electrode means is connected to first electrical lead 31 and includes electrically conductive case 35 having a first end 37 defining an opening into a central cavity 39 and a second end 41 which is closed. The first electrically conductive electrode means also includes an electrically conductive spacer means 43 and a spring means 45.

A second electrically conductive electrode means includes a conductive member 47 which is connected to the second lead 33. Nonconductive means for mounting the first and second electrode means in spaced relation includes a ceramic bushing 49 which is held in place by a groove 51 in case 35. The outer end 37 of case 35 is crimped inwardly against a shoulder of the ceramic bushing 49 to secure it in place. A sealing compound 53 covers the end of the bushing and seals the opening into cavity 39. As shown in the drawings, the second electrically conductive electrode means is positoned within cavity 39.

A heat fusible conductive pellet 55 is positioned in central cavity 39 in electrical contact with the second electrode means. The pellet 55 defines an air gap of predetermined dimension with the first electrode means. The pellet means 55 may advantageously be formed of various alloys. One such alloy which has been found to be useful is composed of 55.5% bismuth and 44.5% lead by weight, having a fusion temperature of approximately 255° F.

Positioned between the pellet means 55 and the conductive spacer means 43 is an insulator means 57 which maintains a predetermined gap between the spacer and pellet means. As seen in FIG. 4, insulator means 57 is annular in shape and may be formed of mica or other insulative material.

When connected for protection of an electrical device, the switching device of the present invention will be positioned in close proximity to the protected device and connected electrically in parallel therewith. The voltage supplied to the protected device will also be provided across leads 31 and 33. During normal operation of the protected device, there will be no current flow between leads 31 and 33 since bushing 49, sealing compound 53 and insulator means 57 will provide electrical isolation between the first and second electrically conductive electrode means. Should, however, the temperature of the protected device rise such that pellet means 55 is heated to a temperature exceeding its fusion temperature, actuation of the switching device will occur, as shown in FIG. 3. The melted pellet material 59 will bridge the gap between conductive member 47 and conductive case 35 and thus provide an electrical connection between leads 31 and 33. As can be seen from FIG. 3, spring means 45 will have moved conductive spacer means 43 and insulator means 57 to the right. The spring 45 is provided in the device to exert a force at all times on the conductive pellet means 55. This constant force is provided in order to insure actuation at the desired predetermined temperature level.

It has been found that pellets of the type used in the present invention which are formed of a conductive metallic material may develop oxide coatings on their outer surfaces. Such coatings will not melt at the predetermined temperature level at which the pure alloy will fuse, but may have a substantially higher fusion temperature. Although not particularly strong, the oxide coating may maintain the structural integrity of the pellet even after the pellet is heated above its fusion temperature. By applying force to the pellet, uniform temperature actuation is obtained since the outer oxide coating will be crushed after the unoxidized interior pellet material has fused. The pellet 55 is generally annular in shape and is positioned in cavity 39 such that it contacts member 47 but is held out of contact with the conductive case 35 until fusion occurs.

The air gap which is provided for overvoltage protection of the protected device is defined between the pellet means 55 and the spacer means 43. The annular insulator means 57, by its thickness, maintains precisely the desired gap dimension. The gap is defined through the interior opening in the insulator means 57. It will be appreciated that variation on gap dimension and, consequently, variation in the electrical potential required for arcing may be effectuated simply by providing insulator means 57 of varying thicknesses.

While the form of apparatus herein described constitutes a preferred embodiment of the present invention, it is to be understood that the invention is not limited to this precise form of apparatus and that changes may be made therein without departing from the scope of the invention.

What is claimed is:

1. A normally open, temperature-sensitive, electrical switching device, having first and second current carrying electrical leads, for completing an electrically conductive circuit between the first and second electrical leads when the temperature of the switching device exceeds a predetermined level and for providing an air gap which permits current to flow between first and second current carrying electrical leads when the voltage across said first and second electrical leads is sufficient to cause arcing across said air gap, comprising:

a first electrically conductive electrode means including a case having a first end defining an opening into a central cavity and a second end which is closed, said first electrode means being electrically connected to said first electrical lead, a second electrically conductive electrode means electrically connected to said second lead, nonconductive means for mounting said second electrode means such that it extends into said central cavity, said nonconductive means sealing said opening into said cavity, a heat fusible, electrically conductive pellet positioned in said central cavity in electrical contact with said second electrode means; and insulator means, positioned between said conductive pellet and said first electrode means, for holding said pellet out of electrical contact with said first electrode means and defining an air gap therebetween of predetermined dimension, whereby an open electrical circuit will be maintained between said first and second electrical leads until said predetermined temperature level is reached and said fusible pellet melts, forming an electrical connection between said first and second electrode means, or until the voltage across said air gap exceeds the voltage level required for arcing thereacross.

2. The normally open, temperature-sensitive, electrical switching device of claim 1 in which said first electrode means further comprises:

conductive spacer means in said central cavity of said case directly abutting said insulator means, and spring means in said central cavity of said case for urging said conductive spacer means toward said insulator means, whereby said air gap will extend between said conductive spacer means and said pellet.

3. The normally open, temperature sensitive means of claim 2 in which said conductive spacer means is cylindrical and said pellet and said insulator means are annular; and the central axes of said conductive spacer means, said pellet, and said insulator means are all substantially aligned in said central cavity of said case.

4. A normally open, temperature sensitive electrical switching device, having first and second electrical leads, comprising:

first electrically conductive electrode means electrically connected to said first electrical lead, second electrically conductive electrode means electrically connected to said second electrical lead, nonconductive means for mounting said first and second electrode means in spaced relation, and heat fusible conductive pellet means, positioned in contact with said second electrode means and defining an air gap of predetermined dimension with said first electrode means, for melting at a predetermined temperature and forming an electrically conductive path between said first and second electrode means, whereby current will flow temporarily between said first and second electrical leads when the voltge across said air gap is sufficient to cause arcing thereacross, and whereby said pellet means will melt at said predetermined temperature and form an electrically conductive path between said first and second electrodes.

5. The electrical switching device of claim 4 further comprising insulator means, positioned between said conductive pellet means and said first electrode means, for maintaining the predetermined dimension of said air gap therebetween.

6. The electrical switching device of claim 5 in which said first electrically conductive electrode means comprises an electrically conductive case connected to said first lead, said case having a first end defining an opening into a central cavity and a second end which is closed, and in which said non-conductive means for mounting includes means for positioning said second electrode in said central cavity of said case.

7. The electrical switching device of claim 6 in which said first electrically conductive electrode means further comprises:

electrically conductive spacer means in said cavity, and spring means for urging said spacer means into direct abutting contact with said insulator means.

8. The electrical switching device of claim 7 in which said insulator means is an annular piece of mica and in which said air gap is defined through the center opening in said annular piece of mica between said pellet means and said electrically conductive spacer means.

* * * * *